United States Patent [19]

Kenyon

[11] 4,275,832

[45] Jun. 30, 1981

[54] RESILIENT SUPPORT MEANS

[75] Inventor: Dennis Kenyon, Leicester, England

[73] Assignee: Dunlop Limited, London, England

[21] Appl. No.: 959,606

[22] Filed: Nov. 13, 1978

[30] Foreign Application Priority Data

Nov. 18, 1977 [GB] United Kingdom ..... 48058/77

[51] Int. Cl.[3] ..... E01B 9/62

[52] U.S. Cl. ..... 238/310; 238/283

[58] Field of Search ..... 238/310, 283, 282, 287, 238/304, 306, 307, 382, 349, 25

[56] References Cited

U.S. PATENT DOCUMENTS

| | | | |
|---|---|---|---|
| 1,133,895 | 3/1915 | Vallin | 238/282 |
| 3,576,293 | 4/1971 | Landis | 238/310 |
| 3,612,395 | 10/1971 | English | 238/310 |
| 3,700,167 | 10/1972 | Jennings et al. | 238/349 |
| 3,831,842 | 8/1974 | Tamura | 238/349 |
| 4,047,663 | 9/1977 | Reynolds et al. | 238/283 |

*Primary Examiner*—John J. Love
*Assistant Examiner*—Ross Weaver
*Attorney, Agent, or Firm*—Stevens, Davis, Miller & Mosher

[57] ABSTRACT

Resilient support means for securing a rail to a rail bed comprises a base member, a rail location member and resilient mounting means acting between the base member and rail location member.

The rail location member has side portions which are inclined relative to the rail abutment surface so that lateral steering forces experienced by a rail result in a combination of shear and compression forces in the resilient mounting means.

The side portions may be inclined at any angle in the range from 15° to 45° preferably 30°.

The side portions may be inclined upwards and outwards relative to a center portion or they may be inclined downwards and outwards relative to the center portion.

The rail location member has means for directly securing a rail to the rail abutment surface.

The mounting means may comprise a single element or a plurality of elements made from a suitable elastomeric material.

11 Claims, 13 Drawing Figures

RESILIENT SUPPORT MEANS

This invention relates to resilient support means and in particular to resilient support means for use in resiliently securing a railway rail to a rail bed.

Particularly where a rail bed is formed from concrete, either in the form of a series of cross-ties or a continuous concrete strip extending in the direction of the length of the rail, it is commonly desired that the rails are mounted resiliently on the rail bed in order to minimize shock loadings on the rail bed and reduce noise transmission compared with that associated with non-resiliently mounted rails.

Furthermore, since many resilient materials such as rubber are also good electrical insulators, resilient mountings are also used where electrical insulation is required between a rail and a rail bed so as not only to provide electrical insulation but give the additional benefit of resilient mounting.

To achieve adequate noise and shock insulation without an unacceptably high change of track gauge when one rail of a pair is subjected to high lateral forces it is required that the resilient mounting has a high degree of resilience in a vertical direction while restraining horizontal movement at the rail head under the action of forces guiding train wheels. Additionally, the mountings should resist rail movement by forces developed along the length of the rail.

One common method of securing a rail to a rail bed is by the use of a spring clip but difficulty is experienced in using such clips with highly resilient mountings. In particular there has been a problem of fatigue failures since the vertical movement effected by the rail when loaded by a train is also experienced by the clip. Because the clip is of a high stiffness rate to provide an adequate holding force it experiences a large variation in stress and this causes a substantial reduction in its working life compared with that of a similar clip used in a non-resilient rail installation.

As used hereinafter in the description and claims terms such as upper and lower are used with reference to the support means when in its normal position of use.

According to the present invention there is provided resilient support means for securing a rail to a rail bed comprising a base member, a rigid rail location member and resilient mounting means acting between the base member and the rail location member, the upper surface of the rail location member defining a rail abutment surface for supporting the base of a rail, the lower surface of the rail location member having side portions defining bearing surfaces at which loads acting on the rail are transmitted to the resilient mounting means and each bearing surface is angled relative to the rail abutment surface to assist in providing lateral stability.

Preferably the bearing surfaces are inclined at an angle in the range from 15° to 45°. More preferably the bearing surfaces are inclined at an angle of 30°. The bearing surfaces may be inclined at substantially the same angle relative to the rail abutment surface for example when the support means is used for a straight track section, or they may be inclined at different angles relative to the rail abutment surface, for example when the support means is used for a curved track section.

Preferably the upper surface of the base member is complementary to the lower surface of the rail location member and is uniformly spaced therefrom.

The rail location member and base member may each comprise a rigid metal plate made for example from sheet steel or cast iron. Alternatively the base member may comprise a rigid metal plate and the rail location member may comprise a solid block, for example a cast concrete block.

The resilient mounting means acts between confronting surfaces of the rail location member and base member. Preferably the mounting means comprises an element of rubber or other elastomeric material acting between the lower surface of the rail location member and the upper surface of the base member. Alternatively the mounting means may comprise two elements of rubber or other elastomeric material, each element acting between a respective bearing surface of the rail location member and the confronting surface of the base member.

Preferably the element(s) is/are bonded to one or preferably both of the confronting surfaces.

Preferably the upper surface of the base member is formed with a plurality of grooves extending in a direction transverse to the length of a rail mounted on the support means and the resilient mounting means is located in the grooves.

Preferably the rail location member includes means for securing a rail to the support means. The securing means preferably comprises two lugs arranged on the upper surface of the rail location member, one on each side of the rail abutment surface, and two spring clips, each spring clip engaging an associated lug and being adapted to engage the rail.

The invention will now be described in more detail, by way of example only, with reference to the accompanying drawings wherein.

Figure 1:
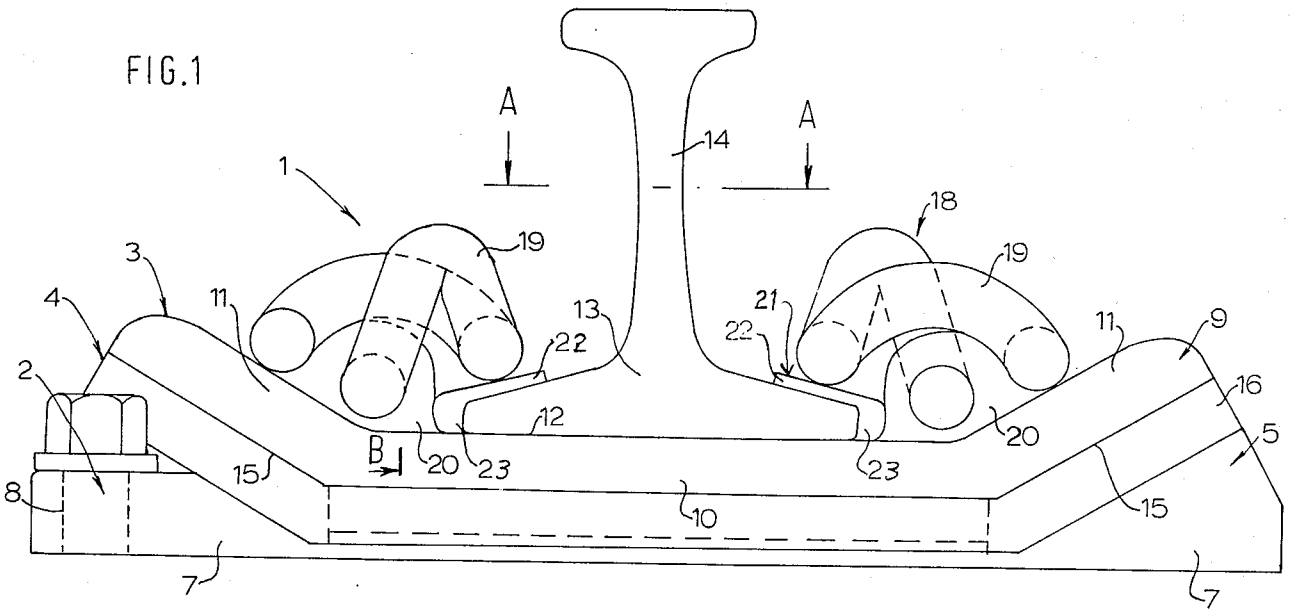
FIG. 1 is a transverse view of a first resilient rail support means according to the invention with a rail mounted thereon.
Figure 2:
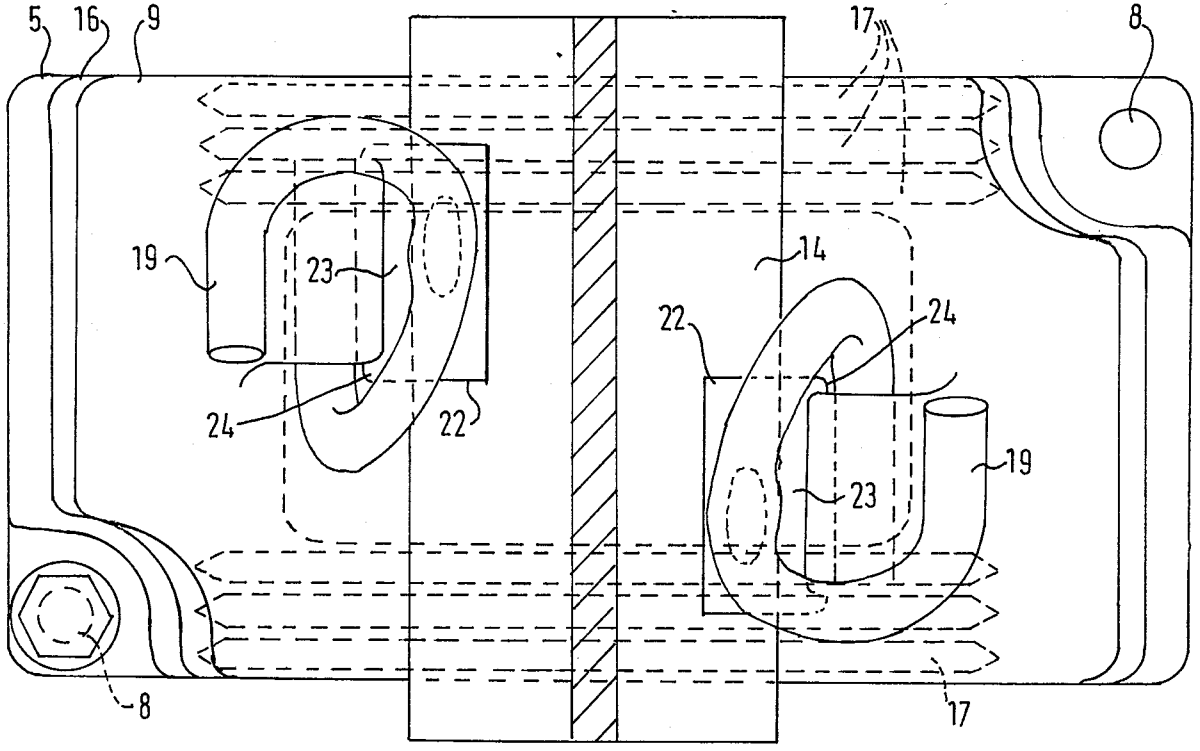
FIG. 2 is a section on the line A—A of FIG. 1.
Figure 3:
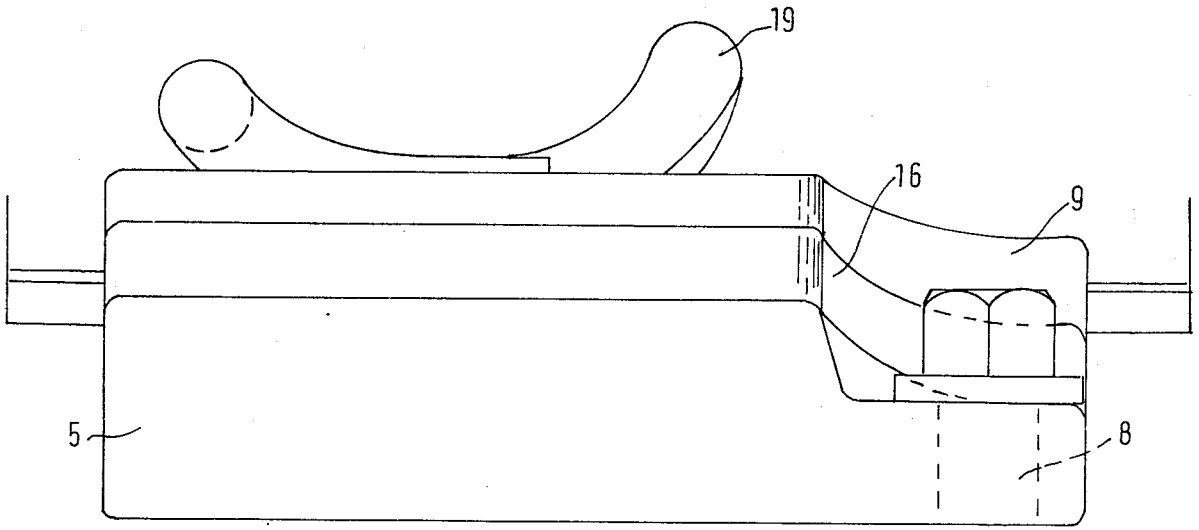
FIG. 3 is a side view of the support means and rail shown in FIGS. 1 and 2.
Figure 4:
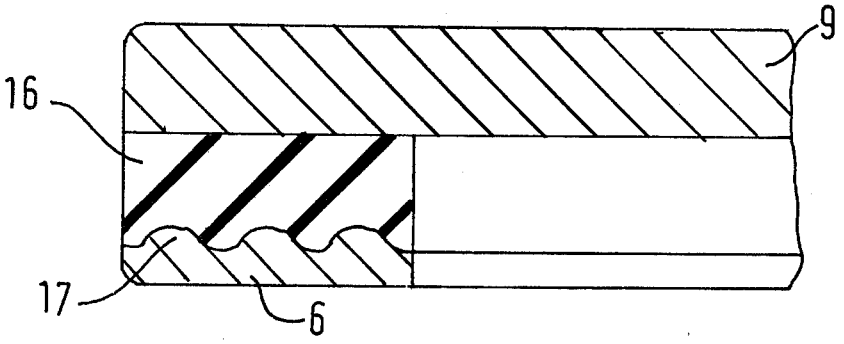
FIG. 4 is a section on the line B—B of FIG. 1.

FIG. *7a* shows the resilient mounting means of the support means shown in FIGS. 1 to 4; and FIGS. *7b* to *7g* show alternative resilient mounting means for use in the support means according to the invention.

The resilient rail support means 1 shown in the accompanying drawings comprises a base member 2, a rail location member 3 and resilient mounting means 4 acting between confronting surfaces of the base member 2 and rail location member 3.

Referring first to the support means 1 shown in FIGS. 1 to 4 of the accompanying drawings, the base member 2 comprises a cast iron plate 5 having a centre portion 6 and side portions 7. The side portions 7 are inclined upwards and outwards at an angle of approximately 30° to the center portion 6. Two bolt location holes 8 are formed in opposed corners of the plate 5 to allow the support means 1 to be bolted to a rail bed (not shown).

The rail location member 3 comprises a plate 9 formed from a substantially rectangular shaped piece of sheet steel. The plate 9 has a center portion 10 and side portions 11. The side portions 11 are inclined upwards ınd outwards at an angle of approximately 30° to the ›entre portion 10. The upper surface of the centre por- ion 10 defines a rail abutment surface 12 for the flange 13 of a rail 14. The lower surface of each side portion 11 lefines a respective bearing surface 15.

The confronting upper and lower surfaces of the base nember 2 and rail location member 3 are of complenentary shape and are uniformly spaced apart by the 'esilient mounting means 4. The mounting means 4 ırranged according to FIG. *7a*, comprises a rubber :lement 16 of substantially uniform thickness bonded to he confronting surfaces of member 2, 3. The central ›ortion of the element 16 is cut away in the centre to 'orm a void or recess to provide the desired resiliency in he vertical and transverse directions. The upper sur- 'ace of the base member 2 has a plurality of grooves 17 vhich extend in a direction transverse to the length of he rail 14 and are filled by the rubber element 16. The grooves 17 increase the bonded area between the ele- nent 16 and the base member 2 and also assist in re- training longitudinal movement of the element 16 rela- ive to the rail 14.

The rail 14 is substantially rigidly secured to the rail ocation member 3 by known securing means 18 com- ›rising two Pandrol spring clips 19 and two lugs 20. The lugs 20 are welded to the upper surface of the nember 3, one on each side of the rail abutment surface 12. Lateral adjustment and positioning of the rail 14 ›etween the lugs 20 is effected by means of two spacers 21 located one on each side of the rail 14 between the 'ail flange 13 and the lugs 20. Each spacer 21 has a limb ›ortion 22 which extends over part of the upper surface ›f the rail flange 13 and a body portion 23 which fits ›etween the edge of the rail flange 13 and the inner face ›f the associated lug 20. The thickness of the body ›ortions 23 is selected such that when the rail 14 is :entrally disposed on the rail location member 3 the ›ody portions 23 are of equal thickness. However when he rail 14 is required to be off-set from the central ›osition the body portions 23 are of unequal thickness, he difference in thickness being equal to the off-set. Each clip 19 is driven into an associated lug 20 and ngages the limb portion 22 of the adjacent spacer to ecure the rail 14 in position. Each spacer 21 has exten- ions 24 at each end which engage the end faces of the ssociated lug 20 to prevent movement of the spacer 21 n the direction of the rail due to the force developed vhen driving the clip 19 into the lug 20 and the forces leveloped along the length of the rail during service.

Referring now to the support means 1 shown in 'IGS. 5 and 6 of the accompanying drawings the base nember 2 is similar to the base member 2 described with eference to the embodiment of FIGS. 1 to 4 and like eference numberals are used to indicate similar parts.

The rail locations member 3 comprises a solid, sub- tantially rectangular concrete block 30 having a cen- ral stepped bore 31 aligned with an aperture 32 in the ›ase member 2 to allow the support means to be bolted ɔ a rail bed (not shown). The upper surface of the nember 3 defines a central rail abutment surface 33 for he flange of a rail (not shown). The lower surface of he member 3 has a centre portion 34 and side portions 5. The centre portion 34 extends in a plane parallel vith the centre portion of the base member 2 and the ide portions 35 are inclined upwards and outwards at n angle of approximately 30° relative to the centre ›ortion 34. The rail abutment surface 33 is slightly in- clined relative to the centre portion 34. Each side por- tion 35 defines a bearing surface 36.

The confronting upper and lower surfaces of the base member 2 and rail location member 3 are of comple- mentary shape and are uniformly spaced apart by the resilient mounting means 4. The mounting means 4 comprises four rubber elements 37, 38, 39 and 40 of substantially uniform thickness bonded to the confront- ing surfaces of the members 2, 3. The elements 37, 38 are of similar shape and act between the bearing sur- faces 36 of the member 3 and the confronting surface of the base member 2. The elements 39, 40 are of similar shape different from the shape of the elements 37, 38 and act between the confronting surfaces of the centre portions 6 and 34 of the members 2 and 3.

A rail (not shown) is substantially rigidly secured to the rail location member 3 by securing means 41 com- prising two spring clips (not shown) and two lugs 42. The lugs 42 have stem portions 43 embedded in the block 34 and are arranged one on each side of the rail abutment surface 33. The lateral positioning of the rail between the lugs 42 is effected by means of one or more spacers in similar fashion to that described with refer- ence to the embodiment of FIGS. 1 to 4.

It will be appreciated that in each of the above- described embodiments lateral steering forces experi- enced by a rail result in a combination of shear and compression forces in the resilient mounting means 4 acting between the inclined bearing surfaces 15 or 36 on the rail location member 3 and the confronting surfaces of the base member 2. The lateral strength of the sup- port means is therefore not wholly dependent on the shear strength of the mounting means 4 or the bond strength between the mounting means 4 and the base member 2 and location member 3. As a result the mounting means 4 may under certain conditions be bonded to one of the members 2, 3 only or may even not be bonded to either member.

Furthermore, by virtue of the inclined bearing sur- faces 15 or 36 on the rail location member 3 being spaced from the centre of a rail there is adequate resis- tance to rotational movement of the rail about an axis extending in the direction of the length of the rail and side forces acting on the rail result in less movement of the rail than would result if the bearing surfaces 15 or 36 lay in a plane parallel with the rail abutment surface i.e. if the lower surface of the location member was planar.

Additionally it will be appreciated that the clip di- rectly interconnects the rail and the rail location mem- ber without any resilient means therebetween. Accord- ingly, the clip is not subjected to the same degree of movement as the relative movement between the rail and the base member 2 and consequently the fatigue life of the clip is considerably increased compared with installations where the clip is subjected to such relative movement.

The invention is not restricted to the above-described embodiments which may be modified in a number of ways. For example FIGS. *7b* to *7g* illustrate alternative resilient mounting means for use in the support means according to the invention. The direction in which a rail extends relative to the mounting means is shown by the arrow A.

FIG. *7b* shows mounting means comprising a single element similar to the mounting means shown in FIG. *7a* in which the centre portion has been cut away at the edges forming voids or recesses in the element to provide the desired resiliency in the vertical and transverse directions.

FIGS. *7c* to *7g* show mounting means comprising a plurality of elements in which the size and shape of the elements is selected to provide the desired resiliency in the vertical and transverse directions.

FIGS. *7d* to *7f* further show mounting means for use in support means in which the bearing surfaces of the rail location member are inclined downwards relative to a plane parallel with the rail abutment surface.

In addition FIG. *7e* shows mounting means including elements which are inclined so as to assist in providing stability in a direction parallel with the direction in which a rail extends.

FIGS. *7f* and *7g* also show mounting means in which the resilient elements for location under the inclined bearing surfaces of the rail location member are curved and it will be appreciated that the confronting surfaces of the rail location member and base member would be similarly profiled.

The resilient mounting means may include one or more reinforcements to alter the spring characteristic of the mounting means to suit widely varying requirements.

The mounting means 4 may be made from any suitable elastomeric material.

Any suitable securing means may be provided for securing a rail to the mounting means.

Figure 5:
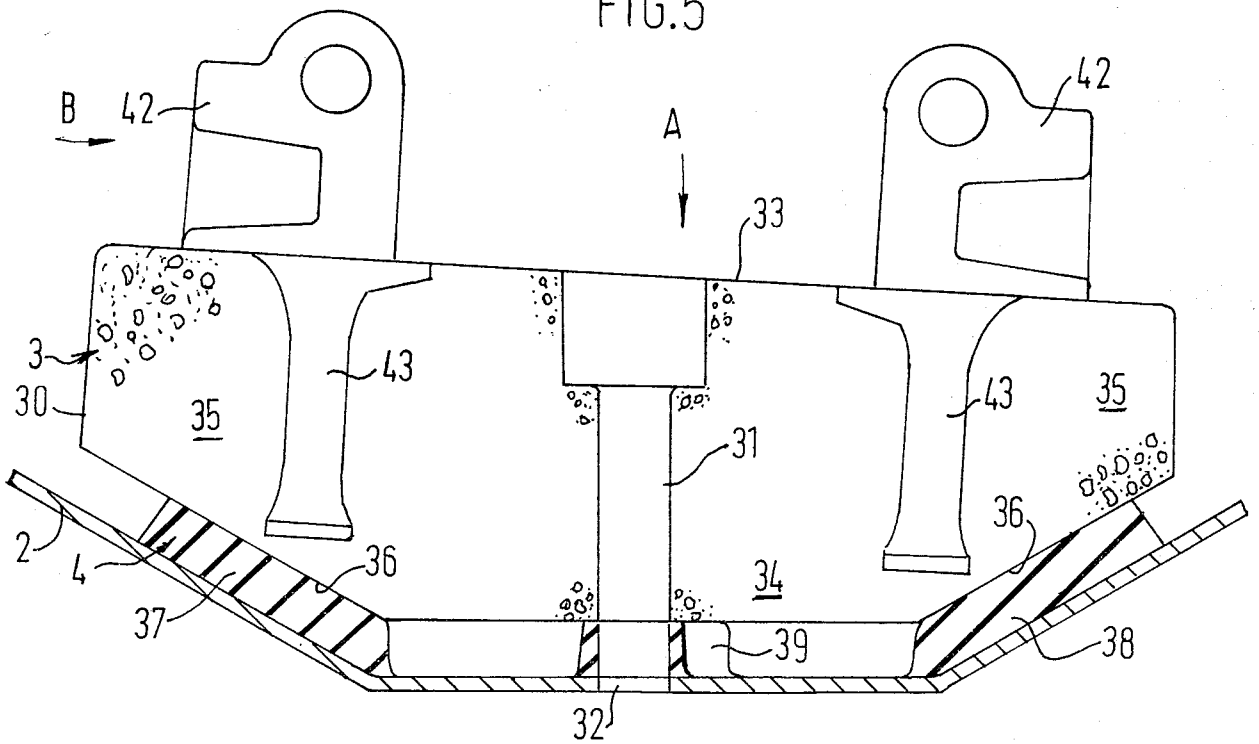
FIG. 5 is a transverse view of a second resilient rail support means according to the invention.
Figure 6:
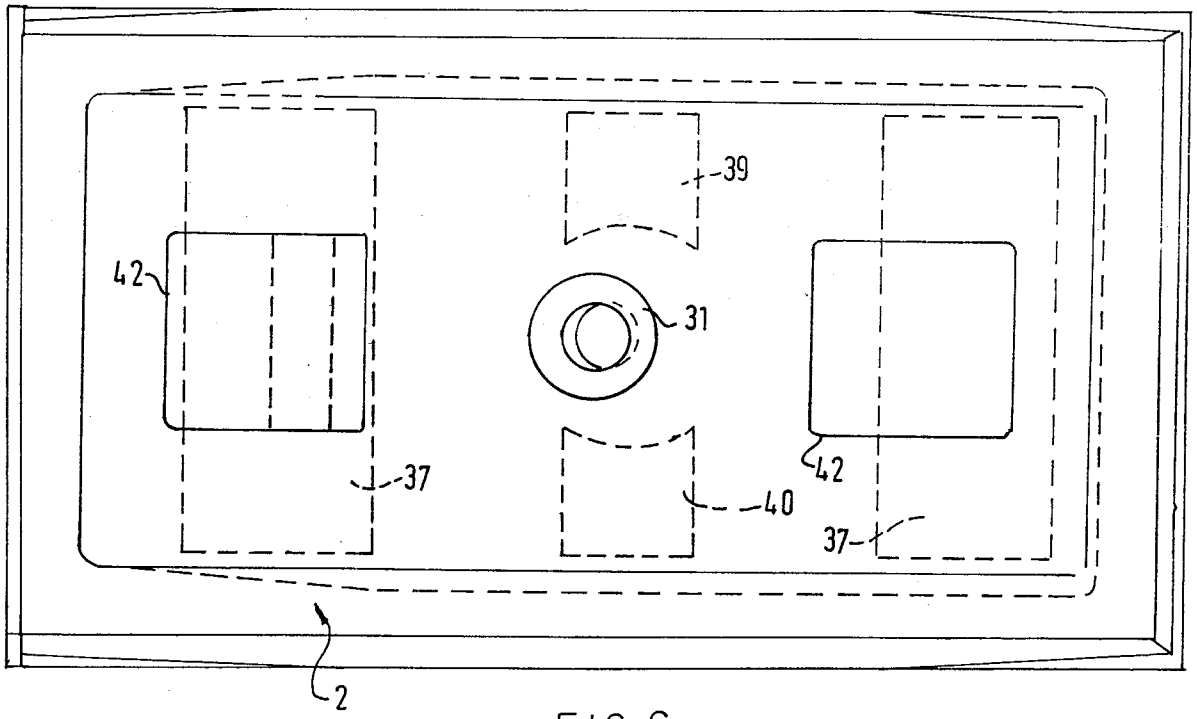
FIG. 6 is a plan view of the support means shown in FIG. 5.
Figure 7A:
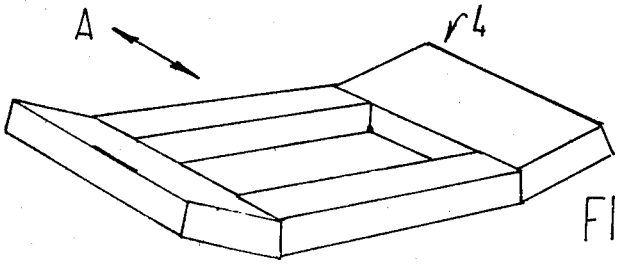
Figure 7B:
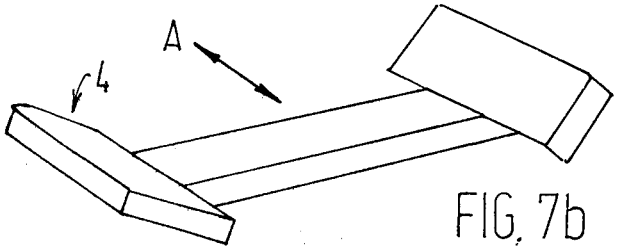
Figure 7C:
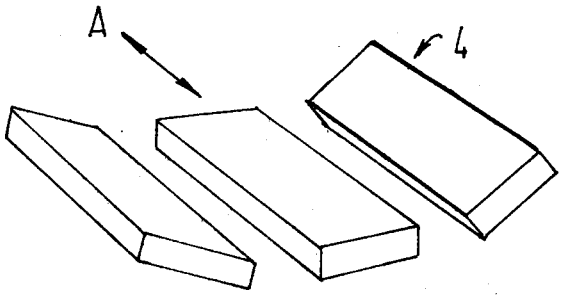
Figure 7D:
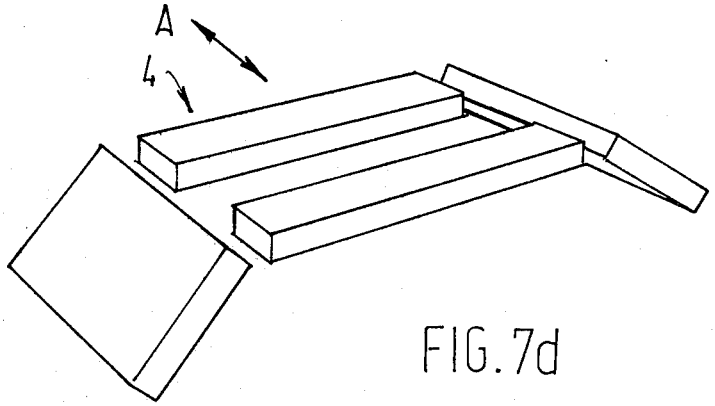
Figure 7E:
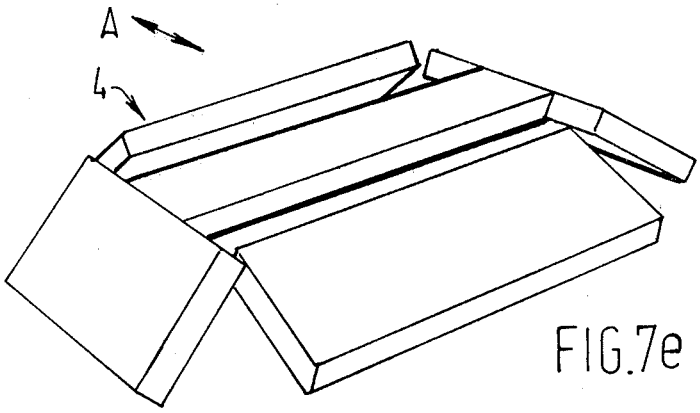
Figure 7F:
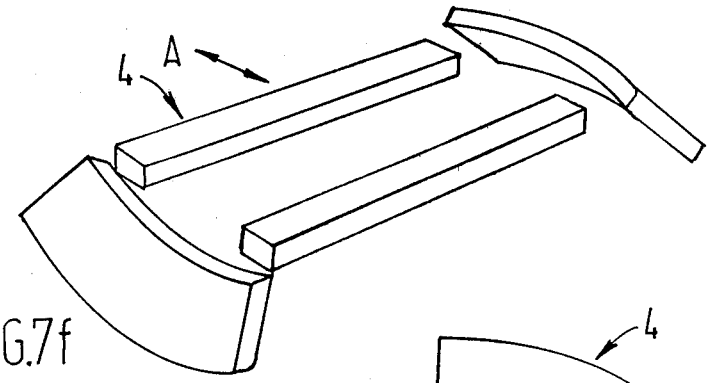
Figure 7G:
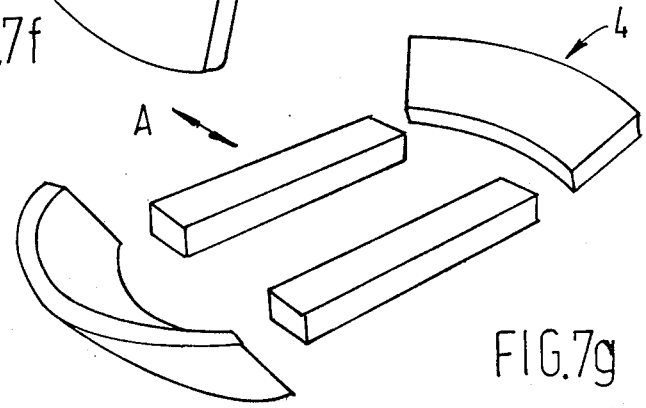

Finally with reference to the embodiment of FIGS. 5 and 6 the stepped bore 31 in the member 3 and the aligned aperture 32 in the base member 2 may be used to provide an inlet for grout or similar material which surrounds the base of the support means and ensures the latter is correctly bedded.

Having now described my invention what I claim is:

1. A rail assembly comprising a rail having a rail head for directly supporting a vehicle wheel and resilient support means securing said rail to a rail bed, said resilient support means comprising a rigid rail location member to which said rail is fastened and a base member, a layer of elastomeric material between confronting surfaces of said rail location member and base member, said elastomeric material being disposed on either side of said rail and providing the sole significant load bearing connection between said base member and said rail location member for both vertical and lateral stresses under normal conditions, at least one of said confronting surfaces on each side of said rail being inclined relative to the vertical and horizontal so that lateral steering forces applied to said rail head are resisted by a combination of shear and compression forces in said elastomeric material, the base member being free of any substantial structure extending above said rail location member.

2. A rail assembly according to claim 1, wherein each inclined surface extends at an angle in the range from 15° to 45° relative to the vertical.

3. A rail assembly according to claim 1, wherein each inclined surface extends at an angle of 30° relative to the vertical.

4. A rail assembly according to claim 3, wherein said confronting surfaces both of said base member and of said rail location member are inclined relative to the vertical.

5. A rail assembly according to claim 4, wherein said confronting surfaces are inclined at equal angles to the vertical.

6. A rail assembly according to claim 1, wherein said elastomeric material is bonded to said confronting surfaces.

7. A rail assembly according to claim 1, wherein the upper surface of said base member is formed with a plurality of grooves extending in a direction transverse to the length of said rail.

8. A rail assembly according to claim 1, wherein said rail is fastened to said rail location member by two lugs arranged on the upper surface of said rail location member, one on each side of said rail, and two spring clips, each spring clip engaging an associated lug and said rail.

9. A rail assembly according to claim 8, including spacing means for locating said rail between said lugs comprising two spacers arranged one on each side of said rail.

10. A rail assembly according to claim 1, wherein said inclined surfaces are defined by side portions of said rail location member which are inclined upwards and outwards relative to a center portion thereof.

11. A rail assembly according to claim 1, wherein said inclined surfaces are defined by side portions of said rail location member which are inclined downwards and outwards relative to a center portion thereof.

* * * * *